United States Patent [19]

Yerkovich et al.

[11] 3,977,108

[45] Aug. 31, 1976

[54] DISPLAY APPARATUS FOR A DATA TERMINAL

[75] Inventors: Simon Yerkovich, Los Angeles; Nicholas Vivian Parrillo, Studio City, both of Calif.

[73] Assignee: Litton Systems, Inc., Beverly Hills, Calif.

[22] Filed: Mar. 17, 1975

[21] Appl. No.: 558,747

[52] U.S. Cl. ..... 40/106.1; 40/18; 40/78.15; 40/104.13

[51] Int. Cl.[2] ..... G09F 13/10

[58] Field of Search ..... 40/106.1, 63 A, 18, 40/64 A, 78, 28 R, 78.05, 78.11, 78.15, 83, 104.13, 104.14; 340/366 G; 240/2 AT; 35/17; 33/184.5

[56] References Cited

UNITED STATES PATENTS

| | | | |
|---|---|---|---|
| 370,186 | 9/1887 | Fountain | 40/18 |
| 632,297 | 9/1899 | Walsh | 40/83 |
| 2,821,037 | 1/1958 | Westphal | 40/106.1 X |
| 3,367,340 | 2/1968 | David et al. | 40/104.13 X |
| 3,384,985 | 5/1968 | Bretz et al. | 40/106.1 |
| 3,611,599 | 10/1971 | Baars | 40/78 |
| 3,811,212 | 5/1974 | Wright | 40/106.1 |
| 3,880,396 | 4/1975 | Freiberger et al. | 40/125 R |

*Primary Examiner*—John F. Pitrelli

[57] ABSTRACT

Display apparatus for a data terminal having a readily accessible deck of message format cards stored in and retained by a card cartridge so that one or more selected cards can be pulled from a stored position, flexed into position over a message display panel assembly, removably connected to the panel assembly, and subsequently returned to the stored position.

10 Claims, 8 Drawing Figures

Fig. 5
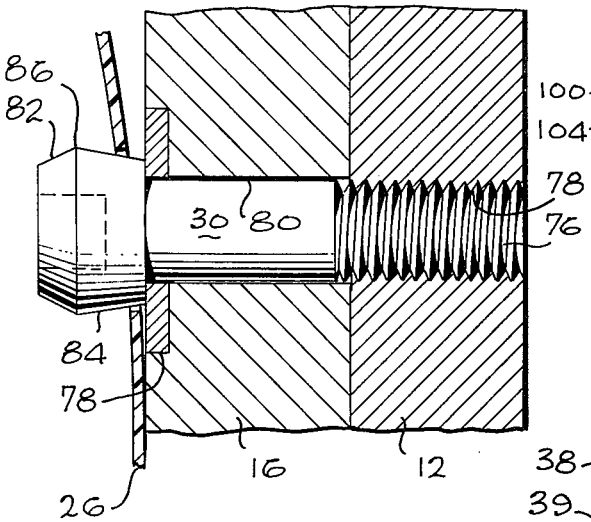
Fig. 4
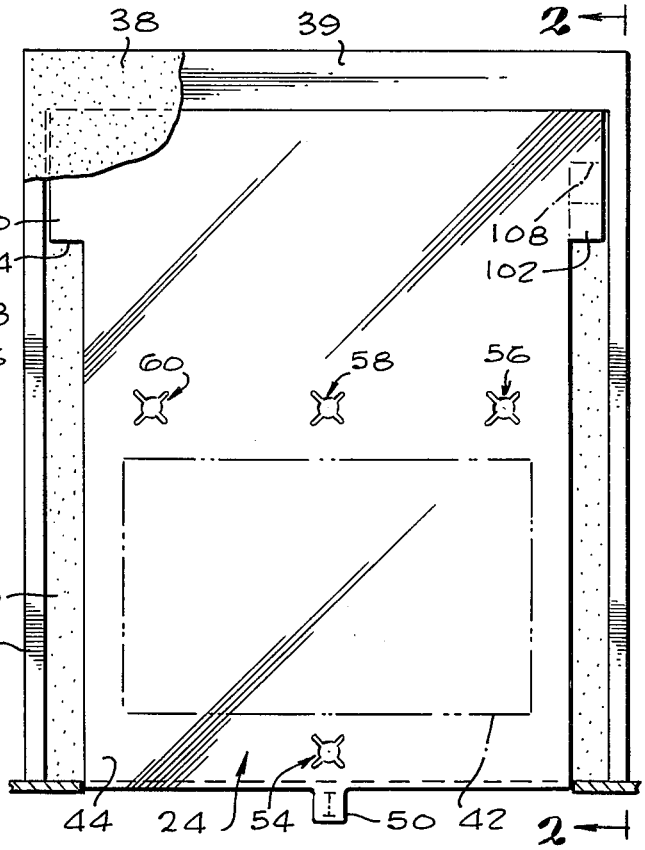
Fig. 3
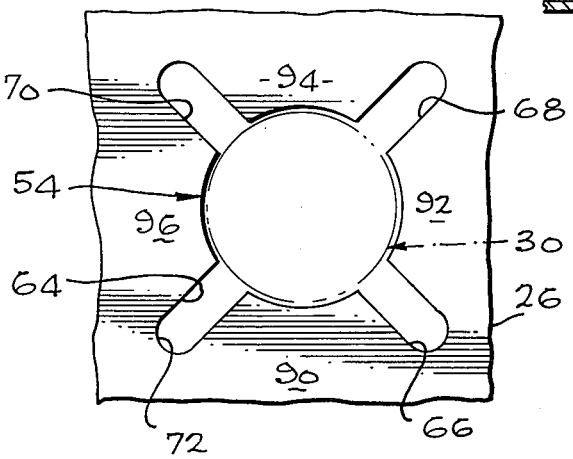
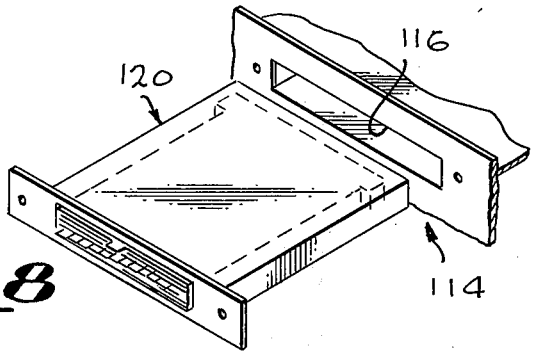
Fig 8
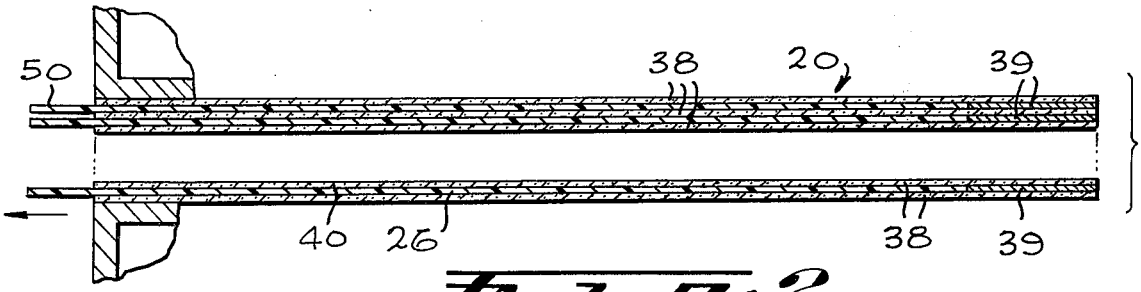
Fig. 2

DISPLAY APPARATUS FOR A DATA TERMINAL

BACKGROUND OF THE INVENTION

Computer independent and computer compatible data terminals for communications purposes have been developed which transfer address and identification data in addition to alphanumeric data via standard radio links and data lines with high transmission reliability.

Accuracy in transmission is of the utmost importance, but the same accuracy is also required to process varying data which frequently must be formatted into a standard data message for use by an operator or observer, or for further transmission to other data terminals as standard data. Such formatting is necessary where the varying data would be otherwise meaningless unless formatted and presented to the operator or observer as a standard data message.

OBJECTS OF THE INVENTION

Accordingly, it is an object of the invention to provide a display apparatus for a data terminal.

It is an object of the invention to provide a display apparatus for a data terminal for the compact storage of multiple format cards.

It is an object of the invention to provide a display apparatus for a data terminal for rapid selection and use of a selected format card.

It is an object of the invention to provide a display apparatus for a data terminal for quick connection of a selected format card to a message display panel of the data terminal.

It is an object of the invention to provide a display apparatus for a data terminal for processing varying data that is displayed by the data terminal into a standard data message.

It is an object of the invention to provide a display apparatus for a data terminal having hingeless format cards.

It is an object of the invention to provide a display apparatus for a data terminal having rugged format cards with increased useable time before failure.

It is an object of the invention to provide a display apparatus for a data terminal for the storage and handling of format cards with reduced damage thereto.

It is an object of the invention to provide a display apparatus for a data terminal that maintains a format card in proper orientation relative to a message display panel of the data terminal.

It is an object of the invention to provide a display apparatus for a data terminal where the apparatus has a format card cartridge for the compact and accessible storage of format cards.

It is an object of the invention to provide a display apparatus for a data terminal where the apparatus has a format card cartridge for the storage of a variable number of format cards.

It is an object of the invention to provide a display apparatus for a data terminal where the apparatus has a format card cartridge for the ready replacement of a format card.

It is an object of the invention to provide a display apparatus for a data terminal where the apparatus has a format card cartridge where the data terminal can be transported without displacement or loss of format cards stored therein.

It is an object of the invention to provide a display apparatus for a data terminal where the apparatus has a format card cartridge that can be replaced as a preloaded cartridge.

SUMMARY OF THE INVENTION

Briefly, in accordance with the invention, a display apparatus for a data terminal having a message display panel is provided; the display apparatus has a display frame that borders the message display panel, suitable connector pins carried by the display frame, a card cartridge with the data terminal that is positioned adjacent to and angularly disposed from the display frame, and a plurality of format cards that are stored within the cartridge for selected use with the display frame and thereby with the message display panel. Each of the format cards is formed from a flexible plastic sheet that is selectively transparent. A tab identifies each stored card and facilitates moving the card from a stored position within the cartridge to an extended position where it is flexed toward the display frame. A limit stop determines the total extension of the selected card and assists in accurately positioning a plurality of apertures in the sheet relative to the connector pins. The apertures snap onto the connector pins to removably fasten the format card to the display frame so that data presented by the message display panel can be formatted as desired.

While the specification concludes with claims particularly pointing out and distinctly claiming the subject matter which may be regarded as the invention, the organization and method of operation, together with further objects, features, and the attending advantages thereof, may best be understood when the following description is read in connection with the accompanying drawing.

BRIEF DESCRIPTION OF THE DRAWING

FIG. 2 is a sectional view of a card cartridge for the display apparatus of FIG. 1 along the line 2—2 of FIG. 3.

FIG. 3 is a plan view, partly broken away, of the card cartridge of FIG. 2 with an index format card.

FIG. 4 is an enlarged view of a slotted aperture in the index format card, partly broken away, of FIG. 3.

FIG. 5 is an enlarged view of a connector pin for the display apparatus of FIG. 1.

FIG. 8 is a perspective view, partly broken away, of another card cartridge for the display apparatus of the invention.

DESCRIPTION OF THE INVENTION

Figure 1:
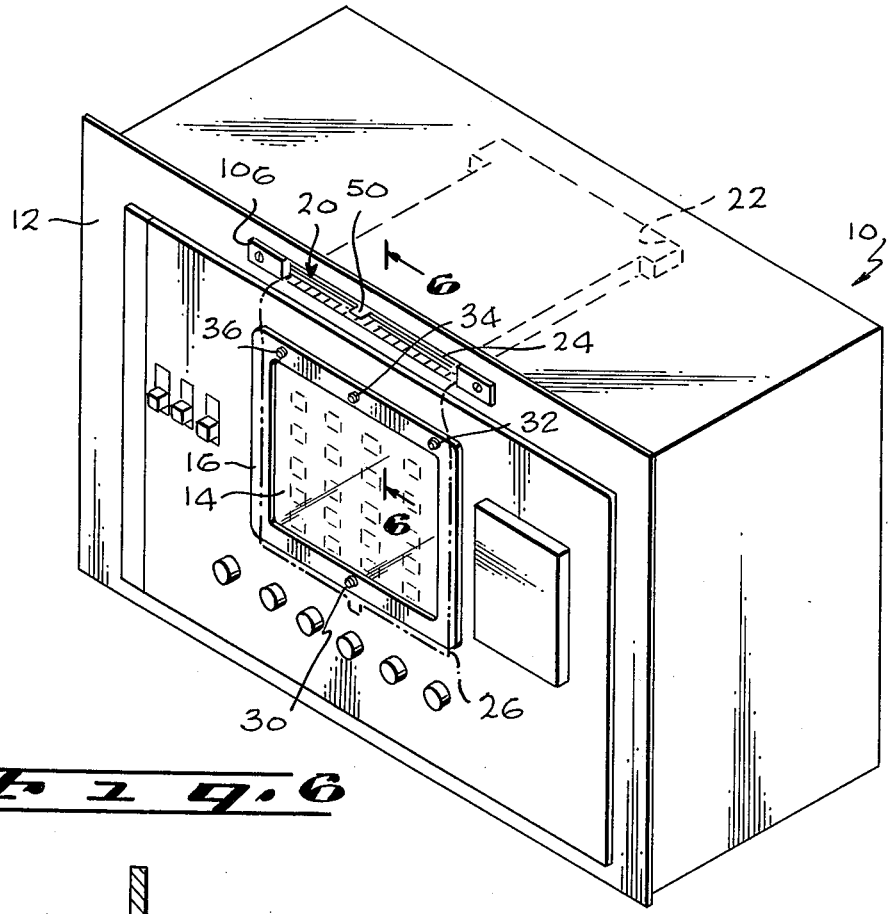
FIG. 1 is a perspective view of the display apparatus of the invention for a data terminal.

Referring to FIG. 1, a display apparatus such as data terminal 10 has a front panel 12 with a message display panel 14. The message display panel 14 presents varying data in a visible form such as lighted data developed by controlled, light-emitting diodes. A planar display frame 16 borders the display panel 14 and is fastened to the front panel 12. A display card cartridge 20 is positioned within a compartment 22, shown in phantom, in the data terminal 10. The compartment is adjacent the display panel 14 and angularly disposed therefrom.

One or more format cards, such as index format card 24 and message format card 26, are removably stored within the cartridge 20. The format cards can be selectively withdrawn, as described hereinafter, from the cartridge 20 but retained thereby, and then releasably connected to the display frame 16 by similar connector pins 30, 32, 34 and 36. For example, message format card 26, shown in phantom, is connected to the connector pins of display frame 16.

The display card cartridge 20 as more particularly shown by FIG. 2 is an assembly of similar sleeve cards 38 spaced apart by suitable spacers 39. The spaced apart sleeve cards 38 develop similar and adjacent format card compartments 40. The sleeve cards 38 are preferably formed from a suitable material or coated with a suitable material that decreases surface friction when a selected format card, such as card 26, is pulled out from a stored position within its card compartment or is pushed into the compartment from an extended position.

Referring to FIG. 3, index format card 24 of FIG. 1 is representative of the physical configuration of a format card. The format cards are formed from a transparent and flexible plastic material which can be colored for filter enhancement of the lighted data presented by the display panel 14. Each format card has a tab 50 that protrudes from the cartridge 20 in a stored position and identifies the card. The tab 50 also permits an operator to pull the format card 24 from its stored position (see extended format card 26 in FIG. 6), and to return the format card to its stored position within card compartment 40 of the cartridge 20.

Each format card, such as format card 24 of FIG. 3, has card extensions 100 and 102 that have similar limit surfaces 104. The limit surfaces 104 impinge upon the rear surface, not shown, of similar compartment edge covers 106 (see FIG. 1) which cooperate to develop limit stops so that a selected format card can not be withdrawn entirely from its card compartment 46 in the card cartridge 20 (see FIG. 2). However, removal of the edge covers 106 permits the easy replacement or rearrangement of the format cards. Since the total number of cards in a card cartridge will determine the total height or thickness of the cartridge, the dimensional position of the limit surfaces 104 can be selected so that the card can be accurately positioned relative to the message display panel 14. For example, if it were required that format card 24 of FIG. 3 be capable of extending an additional distance from the card cartridge 20, such additional distance could be realized by limit surfaces located at 108 as shown in phantom on card extension 102.

The format cards, both index card 24 and message format cards 26, have selected index or message format indicia 42, preferably positioned on one surface, here a top surface 44, of the card. The format cards also have a plurality of slotted apertures 54, 56, 58 and 60, as shown by FIG. 3, that are positioned to snap onto respective connector pins 30, 32, 34 and 36, as generally shown by FIG. 1, to accurately position the format indicia 42 relative to the message display panel 14.

Referring to FIG. 4, slotted aperture 54, which is similar to apertues 56, 58, and 60 of FIG. 3, has radially extending slots 64, 66, 68, and 70 that are preferably angularly equidistant to develop respective land portions 90, 92, 94 and 96 therebetween. The radially extending slots 64, 66, 68, and 70 are preferably oriented so that the maximum possible linear dimension is provided between a tab, such as tab 50 of FIG. 3, and the nearest adjacent slots 64 and 66. This minimizes the probability of tearing the card 24 when the tab 50 is grasped as the card is pulled off the connector pins 30, 32, 34, and 36, and when the card is pulled or pushed from or into its card compartment as described hereinbefore. Each of the slots 64, 66, 68, and 70 have a similar radius 72 which further minimizes the probability of tearing the format card.

Connector pin 30 of FIG. 5, which is representative of the similar connector pins useable with our invention, has a threaded portion 76 that passes through a washer 78, a clear hole 80 in display frame 16, and engages a tapped hole 78 in the front panel 12. The head of pin 30 has opposing truncated conical portions 82 and 84. Conical portion 82 facilitates locating a slotted aperture, such as aperture 54 of FIG. 4, on its connector pin. The abutting conical portions 82 and 84 develop a maximum dimension at junction 86 that is greater than the diameter of aperture 54 so that the land portions 90, 92, 94, and 96 of the slotted aperture flex away from the plane defined by the format card 24 as the card is pushed onto the connector pin. When the card aperture passes over junction 86, the inherent resiliency of the lands 90, 92, 94 and 96 causes each to flex toward the plane of the format card which urges the lands, and therefore the format card, along the decreasing dimension of conical portion 84 toward the display frame 16. This inherent resiliency constantly urges the card against the planar surface of the display frame 16 so that the format card does not flop or warp which could cause distortion of a message on the message display panel 14 when viewed through the format card.

Figure 6:
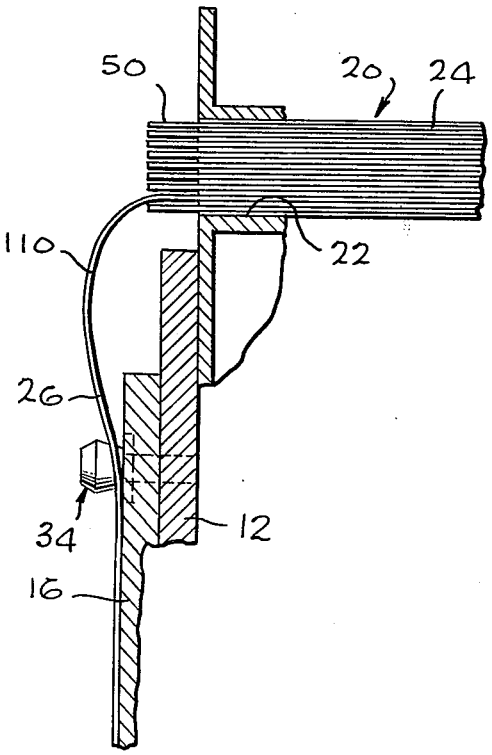
FIG. 6 is a sectional view along the line 6—6 of FIG. 1.
Figure 7:
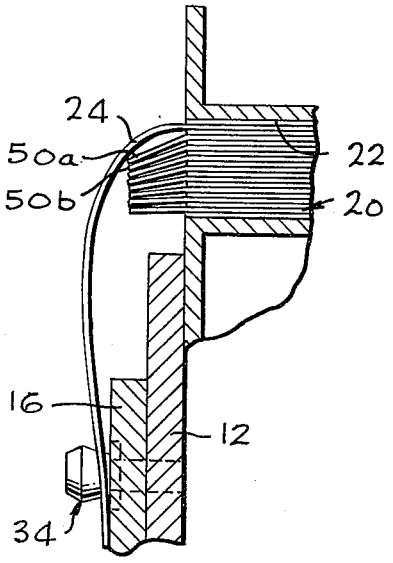
FIG. 7 is a sectional view similar to that of FIG. 6 but with an index format card in operating position.

Operation of the data apparatus of the invention is shown by FIGS. 6 and 7. A desired message format card 26 of FIG. 6 is pulled by its tab 50, not shown, from its sleeve compartment in format card cartridge 20. From its extended position, the format card 26 is flexed into position over the display frame 16, and the card apertures, such as slotted aperture 54 of FIG. 4, positioned on respective connector pins, such as connector pin 34. The format card apertures are then snapped onto the connector pins which, when coupled with the inherent resiliency of the flexible format card which develops a spring characteristic that minimizes the total amount of bow at 110, urges the format card into a flush and planar engagement with the planar display frame 16 as previously described, so that (1) the indicia on the format card (see indicia 42 of FIG. 3) is accurately positioned relative to the message display panel 14 framed by display frame 16, and (2) the planar-planar relationship prevents flopping or warping of the format card which eliminates possible distortion or illegibility of a message displayed by the message display panel when viewed through the transparent format card. It is contemplated that the transparent format card can be selectively opaque where required for proper formatting of a displayed message.

Referring to FIG. 7, when the data apparatus of the invention is not in use or when the index format card 24 is being used with a message displayed by the message display panel as described hereinbefore, the index format card bends the tabs, such as tabs 50*a* and 50*b*, of the message format cards into a locking engagement so that movement of the cards within the card cartridge 20 is substantially reduced if not totally eliminated, and extension of the cards from the cartridge is prevented.

Although the index format card and the message format cards of the invention are loaded into the card cartridge 20 by the removal of edge covers 106 from the cartridge compartment 22 in the data terminal 10 of FIG. 1, another data terminal 114 of our invention as illustrated by FIG. 8 uses a preloaded card cartridge 120 that is releasably fastened within a cartridge compartment 116 by conventional fasteners, not shown.

As will be evidenced from the foregoing description, certain aspects of the invention are not limited to the particular details of construction as illustrated, and it is contemplated that other modifications and applications will occur to those skilled in the art. It is, therfore, intended that the appended claims shall cover such modifications and applications that do not depart from the true spirit and scope of the invention.

We claim:

1. A data terminal comprising:

a message display panel upon which lighted data is displayed;

a card cartridge mounted in fixed relationship to the message display panel, the cartridge including a plurality of card compartments;

a plurality of format cards constructed from hingeless flexible sheets, are positioned in the card compartments, each card having transparent first areas and opaque second areas containing predetermined format indicia, the cards being individually extendable from the card cartridge; and means for accurately positioning an extended format card with respect to the lighted data displayed on the message display panel so that the data may be viewed through the first areas and formatted by the indicia contained on the second areas.

2. The data terminal claimed in claim 1 wherein:

the card cartridge is mounted so that the plane of the card compartments is angularly disposed from the plane of the message display panel.

3. The data terminal claimed in claim 1 wherein each of the format cards further includes:

an identification tab which protrudes from the card cartridge when the card is in a nonextended position therein so that individual cards may be identified and moved between the nonextended position and an extended position; and a limit stop for engaging the card cartridge when the format card has been extended a predetermined distance.

4. The data terminal claimed in claim 3, further comprising:

an index card having an identification tab and a limit stop, the index card being positioned in the card compartment at the greatest distance from the message display panel, the index card serving in the extended position to deflect the identification tabs of the format cards in the other card compartments to restrict motion thereof during storage or transport of the data terminal.

5. The data terminal claimed in claim 1 herein:

the transparent first areas are suitably colored to enhance the filter characteristics thereof with respect of the light emitted by the lighted data.

6. The data terminal claimed in claim 1 wherein the positioning means comprises:

a display frame fastened to the data terminal bordering the message display panel;

at least one connector post projecting from the display frame; and at least one connection aperture on each format card for releasable connection to the connector post.

7. The data terminal claimed in claim 6 wherein:

each connection aperture includes a series of radial slots extending from and equally spaced around a central aperture.

8. The data terminal claimed in claim 7 wherein:

the slots dimensionally nearest an edge of the format card is positioned to place the termination thereof a maximum distance from the edge.

9. The data terminal claimed in claim 7 wherein the post comprises:

a first positioning portion; and a second abutting portion nearest the display frame, the junction between the portions having the greatest cross-section area of the post, the cross-sectional area being greater than the central aperture of the format card but smaller than the total area described by the connection aperture.

10. The data terminal claimed in claim 9 wherein:

the first and second portions of the post are oppositely directed truncated conical surfaces.

* * * * *